US007851984B2

(12) United States Patent
Zdeblick et al.

(10) Patent No.: US 7,851,984 B2
(45) Date of Patent: Dec. 14, 2010

(54) IGNITION DEVICE HAVING A REFLOWED FIRING TIP AND METHOD OF CONSTRUCTION

(75) Inventors: William J. Zdeblick, Ann Arbor, MI (US); Warran Boyd Lineton, Ann Arbor, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 25 days.

(21) Appl. No.: 11/500,850

(22) Filed: Aug. 8, 2006

(65) Prior Publication Data

US 2008/0036353 A1 Feb. 14, 2008

(51) Int. Cl.
*H01T 13/20* (2006.01)

(52) U.S. Cl. ..... 313/141; 313/142; 313/143; 445/7

(58) Field of Classification Search ..... 313/118, 313/141–143; 445/7
See application file for complete search history.

(56) References Cited

U.S. PATENT DOCUMENTS

| | | | | |
|---|---|---|---|---|
| 3,075,066 | A | 1/1963 | Yenni et al. | 219/76 |
| 3,673,452 | A | 6/1972 | Brennen | 313/141 |
| 3,854,067 | A | 12/1974 | Morgan | 313/130 |
| 4,081,710 | A | 3/1978 | Heywood et al. | 313/141 |
| 4,122,366 | A | 10/1978 | von Stutterheim et al. | 313/141 |
| 4,323,756 | A | 4/1982 | Brown et al. | |
| 4,441,012 | A | 4/1984 | Risbeck et al. | |
| 4,546,230 | A | 10/1985 | Sasaki et al. | |
| 4,623,777 | A | 11/1986 | Aihara et al. | |
| 4,634,832 | A | 1/1987 | Martyr | |
| 4,686,342 | A * | 8/1987 | Collier et al. | 148/526 |
| 4,737,612 | A | 4/1988 | Bruck et al. | |
| 4,743,793 | A | 5/1988 | Toya et al. | 313/141 |
| 4,786,267 | A | 11/1988 | Toya et al. | 445/7 |
| 4,826,462 | A | 5/1989 | Lenk | 445/7 |
| 4,853,514 | A | 8/1989 | Lemelson | |
| 4,866,242 | A | 9/1989 | Martyr | |
| 4,903,888 | A | 2/1990 | Clark et al. | |
| 5,127,364 | A | 7/1992 | Savkar et al. | |

(Continued)

FOREIGN PATENT DOCUMENTS

CA 2542092 10/2006

(Continued)

OTHER PUBLICATIONS

I.R. Pashby, S.H. Mok and J. Folkes, Direct Diode Laser Deposition of Titanium Alloys, 2004.

(Continued)

*Primary Examiner*—Bumsuk Won
*Assistant Examiner*—Elmito Breval
(74) *Attorney, Agent, or Firm*—Robert L. Stearns; Dickinson Wright, PLLC

(57) ABSTRACT

A sparkplug having ground and/or center electrodes that include a firing tip formed by reflowing of an end of wire having an opposite end carried by a feed mechanism. The present invention also includes methods of manufacturing an ignition device and electrodes therefore having a firing tip, including providing a metal electrode having a firing tip region; providing a wire having a free end and another end carried by a feed mechanism; and reflowing the free end to form a firing tip.

33 Claims, 8 Drawing Sheets

U.S. PATENT DOCUMENTS

| | | | | |
|---|---|---|---|---|
| 5,137,223 | A | 8/1992 | Brandon et al. | |
| 5,149,936 | A | 9/1992 | Walton, II | |
| 5,205,877 | A * | 4/1993 | Collier et al. | 148/526 |
| 5,250,778 | A * | 10/1993 | Chiu et al. | 219/117.1 |
| 5,371,335 | A * | 12/1994 | McKeon et al. | 219/117.1 |
| 5,371,337 | A | 12/1994 | Campbell et al. | |
| 5,395,273 | A | 3/1995 | Matsutani | |
| 5,408,065 | A | 4/1995 | Campbell et al. | |
| 5,430,270 | A | 7/1995 | Findlan et al. | |
| 5,461,210 | A | 10/1995 | Matsutani | |
| 5,461,275 | A | 10/1995 | Oshima | 313/141 |
| 5,461,276 | A | 10/1995 | Matsutani | |
| 5,468,522 | A | 11/1995 | Honkura et al. | |
| 5,514,849 | A | 5/1996 | Findlan et al. | |
| 5,573,683 | A | 11/1996 | Findlan et al. | |
| 5,578,227 | A | 11/1996 | Rabinovich | |
| 5,615,406 | A | 3/1997 | Sasaki et al. | |
| 5,656,185 | A | 8/1997 | Findlan et al. | |
| 5,667,706 | A | 9/1997 | Pirl et al. | |
| 5,714,735 | A | 2/1998 | Offer | |
| 5,779,842 | A | 7/1998 | Fawcett et al. | 156/250 |
| 5,789,720 | A | 8/1998 | LaGally et al. | |
| 5,796,069 | A | 8/1998 | Jones et al. | |
| 5,889,254 | A | 3/1999 | Jones | |
| 5,977,504 | A * | 11/1999 | Offer et al. | 219/75 |
| 5,990,602 | A | 11/1999 | Katoh et al. | 313/141 |
| 6,060,686 | A | 5/2000 | Jones | |
| 6,132,277 | A * | 10/2000 | Tribble et al. | 445/7 |
| 6,143,378 | A | 11/2000 | Harwell et al. | |
| 6,211,482 | B1 | 4/2001 | Findlan et al. | |
| 6,232,704 | B1 | 5/2001 | Herweg et al. | 313/141 |
| 6,248,058 | B1 | 6/2001 | Silverman et al. | |
| 6,265,815 | B1 | 7/2001 | Reznik | 313/141 |
| 6,274,839 | B1 | 8/2001 | Stone et al. | |
| 6,294,754 | B1 | 9/2001 | Nagura et al. | |
| 6,354,250 | B1 | 3/2002 | Rodriguez Lopez | |
| 6,412,465 | B1 | 7/2002 | Lykowski et al. | 123/169 |
| 6,521,861 | B2 | 2/2003 | Jones et al. | |
| 6,555,779 | B1 | 4/2003 | Obana et al. | |
| 6,596,962 | B2 | 7/2003 | Haschke | |
| 6,611,083 | B2 | 8/2003 | LaBarge et al. | 313/140 |
| 6,614,145 | B2 | 9/2003 | Fleetwood et al. | 313/141 |
| 6,724,133 | B2 | 4/2004 | Miyashita et al. | 313/143 |
| 6,727,459 | B1 | 4/2004 | Bialach | |
| RE38,536 | E | 6/2004 | Reznik | 313/141 |
| 6,770,840 | B2 | 8/2004 | Minamida et al. | |
| 6,793,140 | B2 | 9/2004 | Mazumder | |
| 6,844,521 | B2 | 1/2005 | Staufer et al. | |
| 6,869,328 | B2 * | 3/2005 | Ulm et al. | 445/7 |
| 6,869,508 | B2 | 3/2005 | Darolia et al. | |
| 6,972,390 | B2 | 12/2005 | Hu et al. | |
| 7,009,139 | B2 | 3/2006 | Sonoda et al. | |
| 7,012,217 | B2 | 3/2006 | Titze et al. | |
| 7,019,256 | B2 | 3/2006 | Sonoda et al. | |
| 7,107,118 | B2 | 9/2006 | Orozco et al. | |
| 2001/0013509 | A1 | 8/2001 | Haschke | |
| 2002/0117485 | A1 | 8/2002 | Jones et al. | |
| 2002/0142107 | A1 | 10/2002 | Mazumder et al. | |
| 2002/0165634 | A1 | 11/2002 | Skszek | |
| 2002/0166896 | A1 | 11/2002 | Mazumder | |
| 2002/0171346 | A1 | 11/2002 | Ulm et al. | 313/141 |
| 2003/0038120 | A1 | 2/2003 | Minamida et al. | |
| 2003/0052110 | A1 * | 3/2003 | Gandy et al. | 219/137.7 |
| 2003/0125118 | A1 | 7/2003 | Raghavan et al. | |
| 2003/0136768 | A1 | 7/2003 | Sonoda et al. | |
| 2003/0205957 | A1 * | 11/2003 | Niessner | 313/118 |
| 2003/0222059 | A1 | 12/2003 | De Kock et al. | |
| 2004/0026388 | A1 | 2/2004 | Staufer et al. | |
| 2004/0086635 | A1 | 5/2004 | Grossklaus, Jr. et al. | |
| 2004/0232130 | A1 | 11/2004 | Sonoda et al. | |
| 2004/0249495 | A1 | 12/2004 | Orozco et al. | |
| 2004/0266306 | A1 * | 12/2004 | Matsutani et al. | 445/7 |
| 2005/0029915 | A1 * | 2/2005 | Yorita et al. | 313/141 |
| 2005/0121112 | A1 | 6/2005 | Mazumder et al. | |
| 2005/0167403 | A1 | 8/2005 | Petring | |
| 2005/0173380 | A1 | 8/2005 | Carbone | |
| 2005/0194367 | A1 | 9/2005 | Fredrick, Jr. et al. | |
| 2005/0200255 | A1 * | 9/2005 | Yoshimoto et al. | 313/143 |
| 2005/0211687 | A1 | 9/2005 | Sonoda et al. | |
| 2006/0049153 | A1 | 3/2006 | Cahoon et al. | |
| 2006/0054603 | A1 | 3/2006 | Briand | |
| 2006/0225263 | A1 | 10/2006 | Finton et al. | |
| 2006/0231535 | A1 | 10/2006 | Fuesting | |

FOREIGN PATENT DOCUMENTS

| | | | |
|---|---|---|---|
| DE | 3905684 | | 8/1990 |
| DE | 4140603 | | 6/1993 |
| DE | 19803734 | | 8/1999 |
| DE | 10130468 | | 5/2003 |
| DE | 10130468 | A | 5/2003 |
| EP | 549368 | | 12/1992 |
| EP | 587446 | | 9/1993 |
| GB | 2344549 | | 6/2000 |
| JP | 63033188 | | 2/1988 |
| JP | 1095887 | | 4/1989 |
| JP | 3133587 | | 6/1991 |
| JP | 4157078 | | 5/1992 |
| JP | 05234662 | | 5/1992 |
| JP | 06045049 | | 7/1992 |
| JP | 5050275 | | 3/1993 |
| JP | 200158283 | A | 3/2001 |
| JP | 2005161385 | A | 6/2005 |
| JP | 2005224837 | A | 8/2005 |
| JP | 20067269 | A | 1/2006 |
| JP | 2002239782 | A | 8/2006 |
| WO | WO9843775 | | 10/1998 |
| WO | 2004109871 | A2 | 12/2004 |

OTHER PUBLICATIONS

Pinkerton, Syed, Li, "An Analytical Model of the Combined Powder-Wire Deposition Process", Paper 804, ICALEO 2006 Congress Proceedings, Laser Materials Processing Conference, pp. 506-514.

Nurminen, Riihimaki, Nakki, Vuoristo, "Comparison of Laser Cladding with Powder and Hot and Cold Wire Techniques", Paper 1006, ICALEO 2006 Congress Proceedings, Laser Materials Processing Conference, pp. 634-637.

Han, Kim, Lee, "Development of Laser Cladding Repair System for Damaged Alloy 600 Heat Exchanger Tubes", Paper P522, ICALEO 2006 Congress Proceedings, Laser Materials Processing Conference, pp. 647-653.

Wilden, Bergmann, Dolles, "Improving Laser Cladding Process Conditions by Inducing Skin Effect Through High Frequency Magnetic Field", Paper 1005, ICALEO 2006 Congress Proceedings, Laser Materials Processing Conference, pp. 624-633.

Saida, Song, Nishimoto, "Tandem Brazing of Heat-Resistant Alloys Using Precious Filler Metals", Paper 2204, ICALEO 2006 Congress Proceedings, Laser Materials Processing Conference, pp. 1016-1025.

Meier, Stippler, Ostendorf, Czerner, Matteazzi, "Direct Micro Laser Cladding with Microscale Nanophased Powders". Paper P512, ICALEO 2005 Congress Proceedings, Laser Materials Processing Conference, pp. 325-330.

Wang, Mei, Wu, "Microstructure of Direct Laser Fabricated Compositionally Graded Ti alloys Using Simultaneous Feed of Powder and Wire", Paper 607, ICALEO 2005 Congress Proceedings, Laser Materials Processing Conference, pp. 331-337.

Lin, Yue, Yang, Huang, "Laser Rapid Forming of Graded T16AL4V/RENE88DT Alloy", Paper 608, ICALEO 2005 Congress Proceedings, Laser Materials Processing Conference; pp. 338-343.

Syed, Pinkerton, Liu, Li, "Single-Step Graded Surface Coating Using Combined Wire and Powder Feeding Laser Clading", Paper 1606, ICALEO 2005 Congress Porceedings, Laser Materials Processing Conference, pp. 787-795.

Schmidt, Jahrsdorfer, Mys, Eber, "Laser Micro Welding of Dissimilar Materials", Proceedings of the 23rd International Congress on Applications of Lasers & Electro-Optics 2004.

Klimpel, Lisiecki, Janicki, "New Developments in the Process of the Laser Powder Surfacing", Proceedings of the 23rd International Congress on Applications of Lasers & Electro-Optics 2004, ICALEO 2004 Congress Proceedings.

Jones, Erikson, Nowak, Feng, "Laser Hot-Wire Welding for Minimizing Defects", Proceedings of the 23rd International Congress on Applications of Lasers & Electro-Optics 2004, ICALEO 2004 Congress Proceedings.

Pashby, Mok, Folkes, "Direct Diode Laser Deposition of Titanium Alloys", Proceedings of the 23rd International Congress on Applications of Lasers & Electro-Optics 2004, ICALEO 2004 Congress Proceedings.

Xiao, Zuo, Hugel, "CO2 Laser Beam Welding of Aluminum Alloys with Electric Current Addition", Proceedings of the 23rd International Congress on Applications of Lasers & Electro-Optics 2004, ICALEO 2004 Congress Proceedings.

Syed, Pinkerton, Li, "A Comparative Study of Wire Feeding and Powder Feeding in Direct Diode Laser Deposition for Rapid Prototyping", Applied Surface Science 247 (2005) pp. 268-276.

Li, Yang, Lin, Huang, Li, Zhou, "The Influences of Processing Parameters on Forming Characterizations During Laser Rapid Forming", Materials Science and Engineering A360 (2003) pp. 18-25.

Dilthey, Fuest, Scheller, "Laser Welding with Filler Wire", Optical and Quantum Electronics 27 (1995) pp. 1181-1191.

Syed, Pinkerton, Li, "Simultaneous wire-and powder-feed direct metal deposition: An investigation of the process characteristics and comparison with single-feed methods", Journal of Laser Applications, vol. 18, No. 1, Feb. 2006 pp. 65-72.

Hung, Lin, "Solidification Model of Laser Cladding with Wire Feeding Technique", Journal of Laser Applications, vol. 16, No. 3, Aug. 2004, pp. 140-146.

Salminen, Kujanpaa, "Effect of Wire Feed Position on Laser Welding with Filler Wire", Journal of Laser Applications, vol. 15, No. 1, Feb. 2003, pp. 2-10.

Malin, Johnson, Sciammarella, "Laser Cladding Helps Refurbish US Navy Ship Components", The AMPTIAC Quarterly, vol. 8, No. 3, 2004, pp. 3-9.

Gedda, "Laser Surface Cladding a Literature Survey", Lulea Tekniska Universitet Technical Report, 2000:07, ISSN: 1402-1536.

Capello, Colombo, Previtali, "Repairing of Sintered Tools Using Laser Cladding By Wire", Journal of Materials Processing Technology 164-165 (2005), pp. 990-1000.

Capello, Previtali, "The Influence of Operator Skills, Process Parameters and Materials on Clad Shape in Repair Using Laser Cladding by Wire", Journal of Materials Processing Technology 174 (2006) pp. 223-232.

Syed, Li, "Effects of Wire Feeding Direction and Location in Multiple Layer Diode Laser Direct Metal Deposition", Applied Surface Science 248 (2005) pp. 518-524.

Syed, Pinkerton, Li, "Combining Wire and Coaxial Powder Feeding in Laser Direct Metal Deposition for Rapid Prototyping", Applied Surface Science 252 (2006) pp. 4803-4808.

Kim, Peng, "Melt Pool Shape and Dilution of Laser Cladding with Wire Feeding", Journal of Materials Processing Technology 104 (2000) pp. 284-293.

Kim, Peng, "Plunging Method for Nd: YAG Laser Cladding with Wire Feeding", Optics and Lasers in Engineering 33 (2000) pp. 299-309.

Chen, Hyatt, Islam, "Laser Cladding with Continuous Ni-Al Bronze Wire Feeding", Section F-ICALEO 1999, pp. 58-67.

Hensel, Binroth, Sepold, "A Comparison of Powder-and Wire-Fed Laser Beam Cladding", ECLAT 1992 Conference Proceedings pp. 39-44.

Yelistratov,Sciammerella, "Laser Surfacing with Wire Feeding", 2005 Welding Journal pp. 36-39.

Bouaifi, Bartzsch, "Surface Protection by Laser-Beam Deposition with Hot Wire Addition", Welding and Cutting vol. 4 1993 pp. 202-204.

Stern, Burchards, Mordike, "Laser Cladding with Preheated Wires", Laser Treatment of Materials, 1992 pp. 223-228.

Chong, Man, Chan, "Laser Wire Cladding of Aluminum Alloy", Section F-ICLEO 1999, pp. 207-215.

Alam, Harris, Soltan, "Effect of Powder and Wire Delivery in Laser Cladding on Microstructure of Clad Overlays", WTIA Conference Proceedings, 2002, pp. 1-9.

Draugelates, Bouaifi, Schreiber, Zellerfeld, Haferkamp, Schmidt, Marquering, Hannover, "Corrosion and Wear Protection by CO2-Laser Beam Cladding Combined with the Hot Wire Technology", ECLAT 1994 Conference Proceedings, pp. 344-354.

Demure, Aubry, Chaventon, Sabatier, "Evaluation of Rapid Prototyping with Filler Wire and CO2 or YAG Laser", Section D-ICALEO 2000 Congress Proceedings, pp. 40-46.

Moures, Cicala, Sallamand, Grevey, Vannes, Ignat, "Optimisation of Refractory Coatings Relaised With Cored Wire Addition Using a High-Power Diode Laser", Surface & Coatings Technology 200 (2005) pp. 2283-2292.

Becker, Binroth, Sepold, "Experiences with Laser Beam Wire Coatings", Optoelektronik in der Technik, 9th Congress 1989 pp. 501-505.

* cited by examiner

FIG - 5D
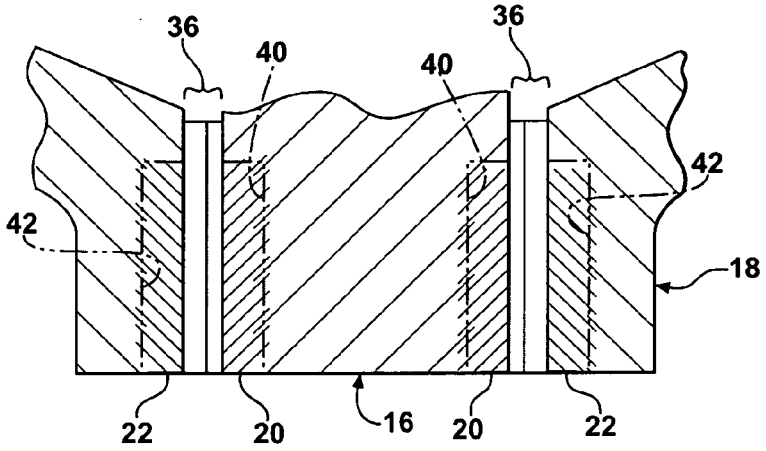
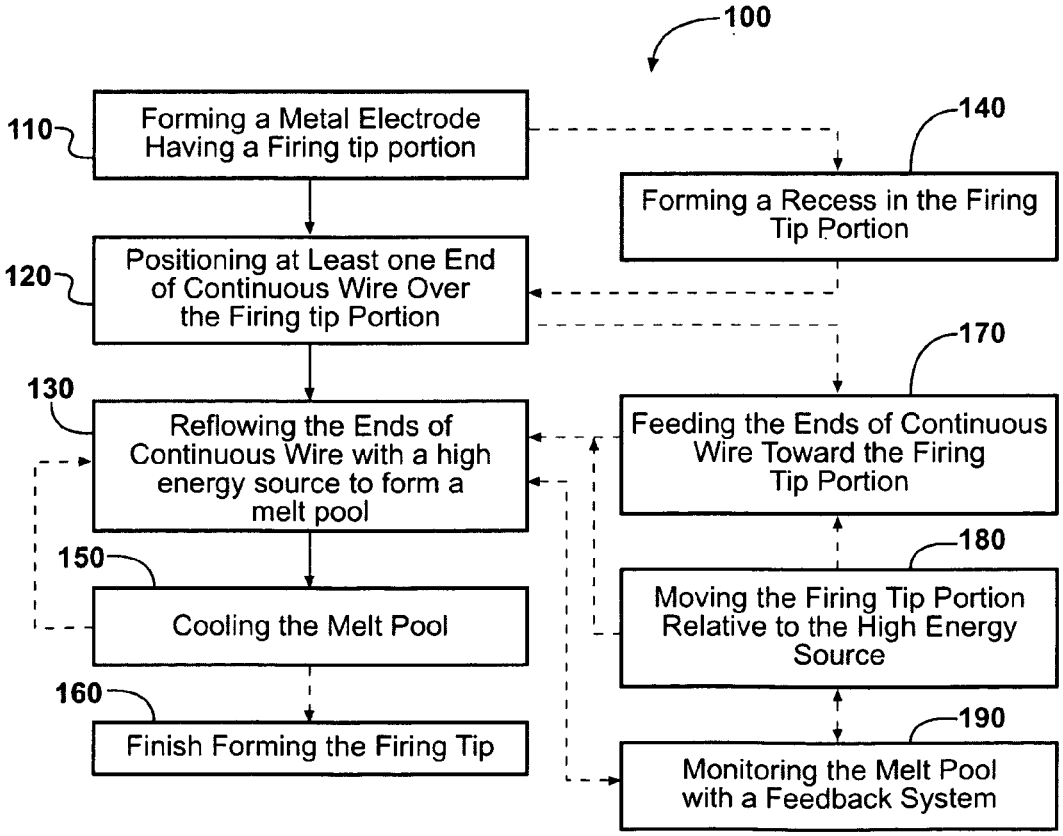
FIG - 6

IGNITION DEVICE HAVING A REFLOWED FIRING TIP AND METHOD OF CONSTRUCTION

BACKGROUND OF THE INVENTION

1. Technical Field

This invention relates generally to sparkplugs and other ignition devices, and more particularly to electrodes having firing tips on sparkplugs and other ignition devices used in internal combustion engines and there method of construction.

2. Related Art

Within the field of sparkplugs, there exists a continuing need to improve the erosion resistance and reduce the sparking voltage at the sparkplug's center and ground electrode, or in the case of multi-electrode designs, the ground electrodes. Various designs have been proposed using noble metal electrodes or, more commonly, noble metal firing tips applied to standard metal electrodes. Typically, the firing tip is formed as a pad or rivet which is then welded onto the end of the electrode.

Platinum and iridium alloys are two of the noble metals most commonly used for these firing tips. See, for example, U.S. Pat. No. 4,540,910 to Kondo et al. which discloses a center electrode firing tip made from 70 to 90 wt % platinum and 30 to 10 wt % iridium. As mentioned in that patent, platinum-tungsten alloys have also been used for these firing tips. Such a platinum-tungsten alloy is also disclosed in U.S. Pat. No. 6,045,424 to Chang et al., which further discloses the construction of firing tips using platinum-rhodium alloys and platinum-iridium-tungsten alloys.

Apart from these basic noble metal alloys, oxide dispersion strengthened alloys have also been proposed which utilize combinations of the above-noted metals with varying amounts of different rare earth metal oxides. See, for example, U.S. Pat. No. 4,081,710 to Heywood et al. In this regard, several specific platinum and iridium-based alloys have been suggested which utilize yttrium oxide ($Y_2O_3$). In particular, U.S. Pat. No. 5,456,624 to Moore et al. discloses a firing tip made from a platinum alloy containing <2% yttrium oxide. U.S. Pat. No. 5,990,602 to Katoh et al. discloses a platinum-iridium alloy containing between 0.01 and 2% yttrium oxide. U.S. Pat. No. 5,461,275 to Oshima discloses an iridium alloy that includes between 5 and 15% yttrium oxide. While the yttrium oxide has historically been included in small amounts (e.g., <2%) to improve the strength and/or stability of the resultant alloy, the Oshima patent discloses that, by using yttrium oxide with iridium at >5% by volume, the sparking voltage can be reduced.

Further, as disclosed in U.S. Pat. No. 6,412,465 B1 to Lykowski et al., it has been determined that reduced erosion and lowered sparking voltages can be achieved at much lower percentages of yttrium oxide than are disclosed in the Oshima patent by incorporating the yttrium oxide into an alloy of tungsten and platinum. The Lykowski patent discloses an ignition device having both a ground and center electrode, wherein at least one of the electrodes includes a firing tip formed from an alloy containing platinum, tungsten, and yttrium oxide. Preferably, the alloy is formed from a combination of 91.7%-97.99% platinum, 2%-8% tungsten, and 0.01%-0.3% yttrium, by weight, and in an even more preferred construction, 95.68%-96.12% platinum, 3.8%-4.2% tungsten, and 0.08%-0.12% yttrium. The firing tip can take the form of a pad, rivet, ball, or other shape and can be welded in place on the electrode.

While these and various other noble metal systems typically provide acceptable sparkplug performance, some well-known and inherent performance limitations associated with the methods which are used to attach the noble metal firing tips to the electrodes, particularly various forms of welding, exist. In particular, cyclic thermal stresses in the operating environments of the sparkplugs, such as those resulting from a mismatch in thermal expansion coefficients between the noble metals and noble metal alloys mentioned above, which are used for the firing tips, and the Ni, Ni alloy and other well-known metals which are used for the electrodes, are known to result in cracking, thermal fatigue and various other interaction phenomena that can result in the failure of the welds, and ultimately of the sparkplugs themselves.

SUMMARY OF THE INVENTION

A method of manufacturing an electrode for an ignition device includes providing an electrode body constructed from one metallic material; providing an elongate wire having a free end, with the wire being formed of another metallic material that is different than the metallic material of the electrode body, and providing a high energy emitting device. Further, feeding the free end of the wire into a focal zone of high energy emitted from the high energy emitting device and forming a melt pool of the wire material from the free end on a surface of the electrode body. Next, cooling the melt pool to form a solidified firing tip on the electrode.

Another aspect of the invention includes a method of manufacturing an ignition device for an internal combustion engine. The method includes providing a housing and securing an insulator within the housing with an end of the insulator exposed through an opening in the housing. Further, mounting a center electrode within the insulator with a free end of the center electrode extending beyond the insulator, and extending a ground electrode from the housing with a portion of the ground electrode being located opposite the free end of the center electrode to define a spark gap therebetween. In addition, providing an elongate wire of metal having a free end and providing a high energy emitting device. Next, melting the free end of the elongate wire to form a melt pool of the metal on at least a selected one of the center electrode or ground electrode with the high energy emitting device while feeding the free end of the wire toward the selected electrode. Further, cooling the melt pool to form a solidified firing tip on the selected electrode.

Another aspect of the invention includes an electrode for an ignition device. The electrode has a body constructed from one metallic material, and a firing tip formed on the body. The firing tip is formed at least in part from a different material than the body and defines a transition gradient extending from the body. The transition gradient includes a generally homogenous mixture of the metallic material adjacent the body, with the homogeneous mixture including the material forming the body and the different material forming at least a portion of the firing tip.

Yet another aspect of the invention includes an ignition device for an internal combustion engine. The ignition device includes a housing having an opening with an insulator secured within the housing with an end of the insulator being exposed through the opening. A center electrode is mounted within the insulator and has a free end extending beyond the insulator. A ground electrode extends from the housing and has a portion located opposite the free end of the center electrode to define a spark gap therebetween. At least a selected one of said center electrode or ground electrode has a firing tip, with the firing tip being formed at least in part from a different material than the selected electrode. A transition gradient extends from the selected electrode and includes a generally homogenous mixture of the material forming the body and the different material forming at least a portion of the firing tip.

BRIEF DESCRIPTION OF THE DRAWINGS

These and other features and advantages of the present invention will become more readily appreciated when considered in connection with the following detailed description of the presently preferred embodiments and best mode, and appended drawings, wherein like features have been given like reference numerals, and wherein:

FIG. 5D is a cross-sectional view of a fourth embodiment of region 5 of region 4 of the sparkplug of FIG. 3;

FIG. 6 is a schematic representation of a method of constructing a sparkplug according to a presently preferred embodiment of the invention;

DETAILED DESCRIPTION OF THE PREFERRED EMBODIMENTS

Figure 1:
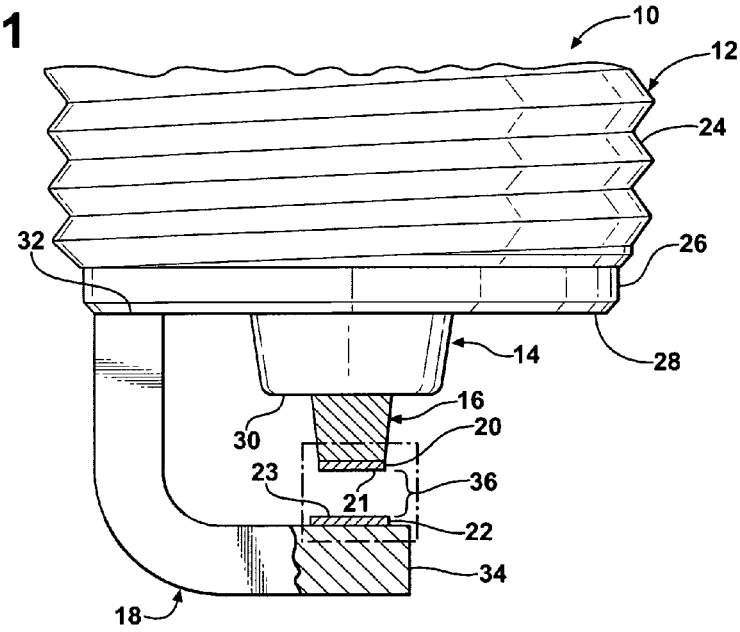
FIG. 1 is a fragmentary and partial cross-sectional view of a sparkplug constructed in accordance with a presently preferred embodiment of the invention.

Referring to FIG. 1, there is shown the working end of a sparkplug 10 constructed according to one presently preferred method of manufacture of the invention. The sparkplug 10 includes a metal casing or housing 12, an insulator 14 secured within the housing 12, a center electrode 16, a ground electrode 18, and a pair of firing tips 20, 22 located opposite each other on the center and ground electrodes 16, 18, respectively. The housing 12 can be constructed in a conventional manner as a metallic shell and can include standard threads 24 and an annular lower end 26 to from which the ground electrode 18 extends, such as by being welded or otherwise attached thereto. Similarly, all other components of the sparkplug 10 (including those not shown) can be constructed using known techniques and materials, with exception to the center and/or ground electrodes 16, 18 which are constructed with firing tips 20 and/or 22 in accordance with the present invention.

As is known, the annular end 26 of housing 12 defines an opening 28 through which the insulator 14 preferably extends. The center electrode 16 is generally mounted within insulator 14 by a glass seal or using any other suitable technique. The center electrode 16 may have any suitable shape, but commonly is generally cylindrical in shape having an arcuate flair or taper to an increased diameter on the end opposite firing tip 20 to facilitate seating and sealing the end within insulator 14. The center electrode 16 generally extends out of insulator 14 through an exposed, axial end 30. The center electrode 16 is generally constructed from any suitable conductor, as is well-known in the field of sparkplug manufacture, such as various Ni and Ni-based alloys, for example, and may also include such materials clad over a Cu or Cu-based alloy core.

Figure 3:
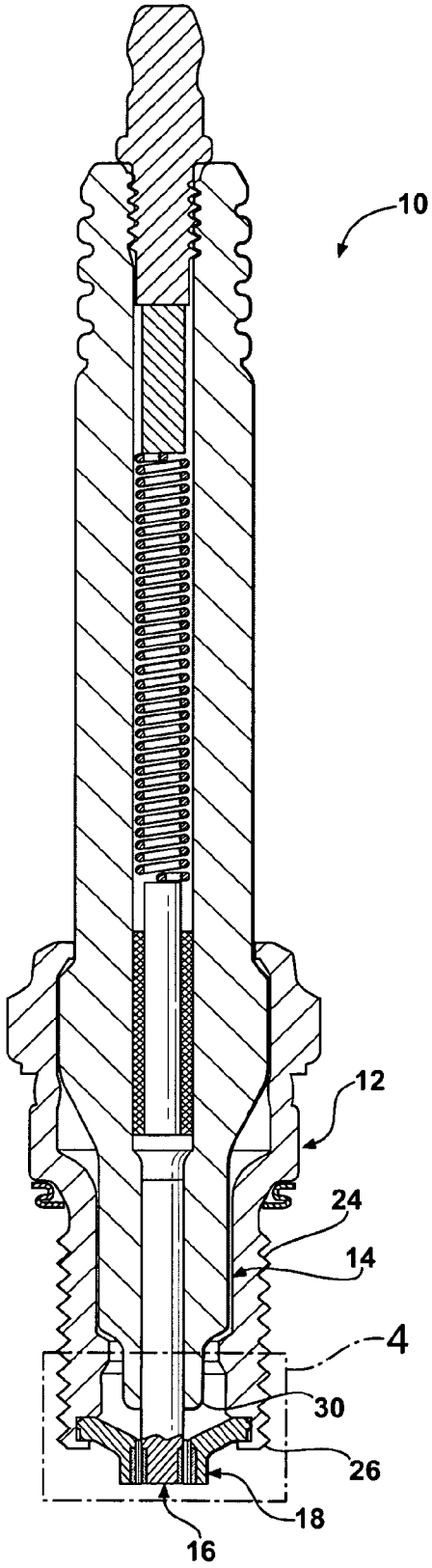
FIG. 3 is a cross-sectional view of a sparkplug constructed in accordance with another presently preferred embodiment of the invention.

The ground electrode 18 is illustrated, by way of example and without limitations, in the form of a conventional arcuate ninety-degree elbow of generally rectangular cross-sectional shape. The ground electrode 18 is attached to the housing 12 at one end 32 for electrical communication therewith and preferably terminates at a free end 34 generally opposite the center electrode 16. A firing portion or end is defined adjacent the free end 34 of the ground electrode 18 that, along with the corresponding firing end of center electrode 16, defines a spark gap 36 therebetween. However, it will be readily understood by those skilled in the art that the ground electrode 18 may have a multitude of shapes and sizes. For example, as shown in FIG. 3, where the housing 12 is extended so as to generally surround the center electrode 16, the ground electrode 18 may extend generally straight from the lower end 26 of the housing 12 generally parallel to the center electrode 16 so as to define spark gap 36 (FIGS. 5A-5D). As will also be understood, the firing tip 20 may be located on the end or sidewall of the center electrode 16, and the firing tip 22 may be located as shown or on the free end 34 of ground electrode 18 such that the spark gap 36 may have many different arrangements and orientations.

The firing tips 20, 22 are each located at the firing ends of their respective electrodes 16, 18 so that they provide sparking surfaces 21, 23, respectively, for the emission and reception of electrons across the spark gap 36. As viewed from above firing tip surfaces 21, 23 (FIGS. 2A-2D) of the firing tips 20, 22, the firing tip surfaces 21, 23 may have any suitable shape, including rectangular, square, triangular, circular, elliptical, polygonal (either regular or irregular) or any other suitable geometric shape. These firing ends are shown in cross-section for purposes of illustrating the firing tips 20, 22 which, in this embodiment of the invention, comprise metals, at least some of which are different from the electrode metal, such as noble metals, for example, reflowed into place on the firing tips in accordance with the invention.

Figure 2A:
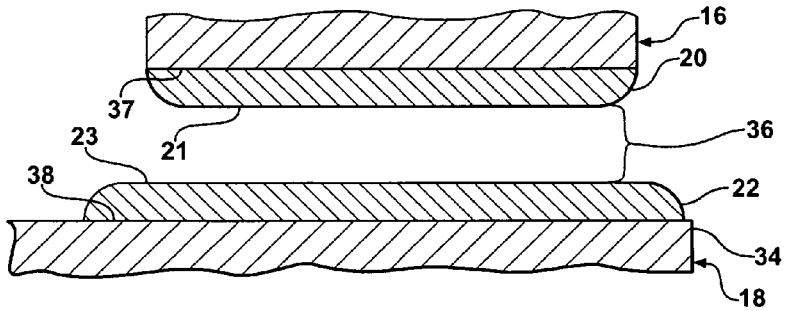
FIG. 2A is a cross-sectional view of a first embodiment of region 2 of the sparkplug of FIG. 1.
Figure 2B:
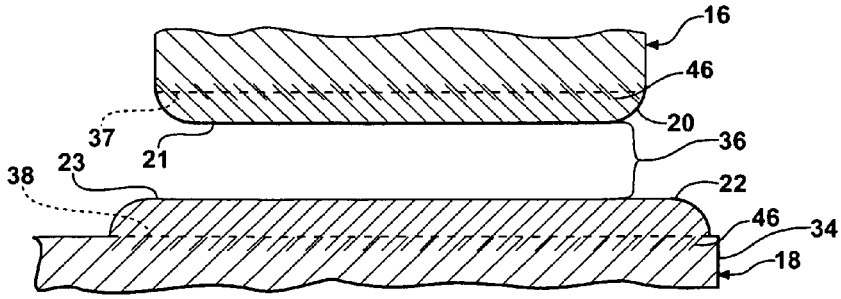
FIG. 2B is a cross-sectional view of a second embodiment of region 2 of the sparkplug of FIG. 1.
Figure 2C:
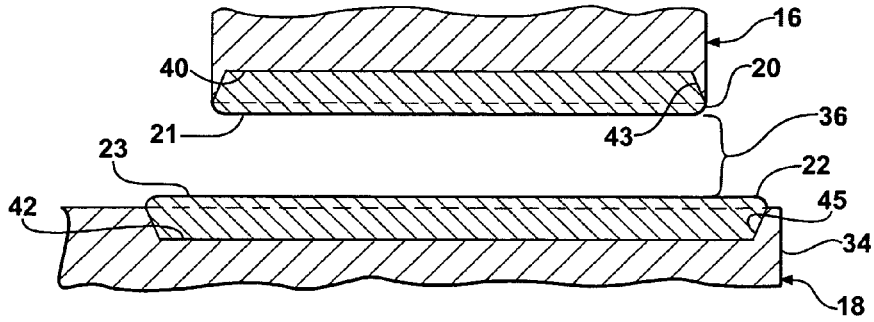
FIG. 2C is a cross-sectional view of a third embodiment of region 2 of the sparkplug of FIG. 1.
Figure 2D:
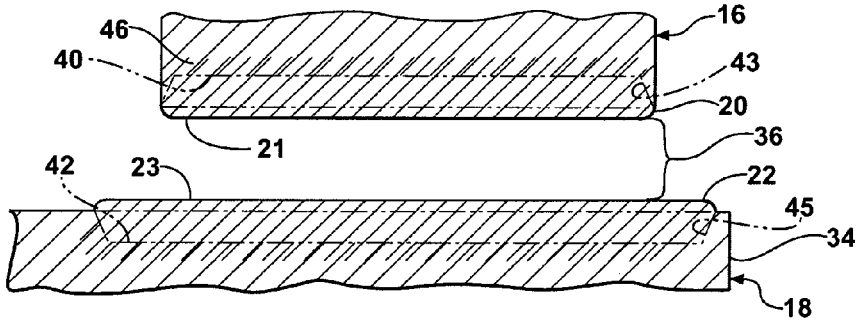
FIG. 2D is a cross-sectional view of a fourth embodiment of region 2 of the sparkplug of FIG. 1.

As shown in FIGS. 2A and 2B, the firing tips 20, 22 can be reflowed in accordance with the invention onto generally flat surfaces 37, 38 of the electrodes 16, 18, respectively. Alternately, as shown in FIGS. 2C and 2D, the firing tips 20, 22 can be reflowed in accordance with the invention into respective recesses 40, 42 provided in one or both of the surfaces of respective electrodes 16, 18. Any combination of surface reflowed and recess reflowed for the center and ground electrodes 16, 18 is possible. Accordingly, one or both of the tips 20, 22 can be fully or partially recessed on its associated electrode, or reflowed onto the outer surface of the electrode without being recessed. The recess 40, 42 formed in the electrode 16, 18 prior to reflow of the firing tip 20, 22 may be of any suitable cross-sectional shape, including rectangular, square, triangular, circular or semicircular, elliptical or semi-elliptical, polygonal (either regular or irregular), arcuate (either regular or irregular) or any other suitable geometric shape. The recess 40, 42 defines a sidewall 43, 45 which may be orthogonal to the firing tip surface 21, 23, or may be oblique, either inwardly or outwardly. Further, the sidewall profile may be a linear or curvilinear profile. As such, the recess 40, 42 may take on any suitable three-dimensional shape, including boxed, frustoconical, pyramidal, hemispherical, and hemi-elliptical, for example.

The firing tips 20, 22 may be of the same shape and have the same surface area, or they may have different shapes and surface areas. For example, it may be desirable to make the firing tip 22 such that it has a larger surface area than the firing tip 20 in order to accommodate a certain amount of axial misalignment of the electrodes 16, 18 in service without negatively affecting the spark transmittance performance of the sparkplug 10. It should be noted that it is possible to apply firing tips of the present invention to just one of the electrodes 16, 18, however, it is known to apply firing tips 20, 22 to both the electrodes 16, 18 to improve the overall performance of the sparkplug 10, and particularly, its erosion and corrosion resistance at the firing ends. Except where the context states otherwise, it will be understood that references herein to firing tips 20, 22 may be to either or both of the firing tips 20, 22.

Figure 4:
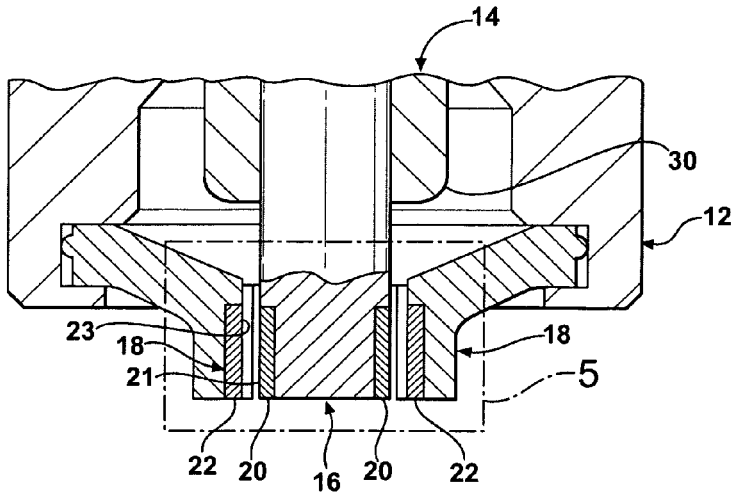
FIG. 4 is a cross-sectional view of region 4 of the sparkplug of FIG. 3.
Figure 5A:
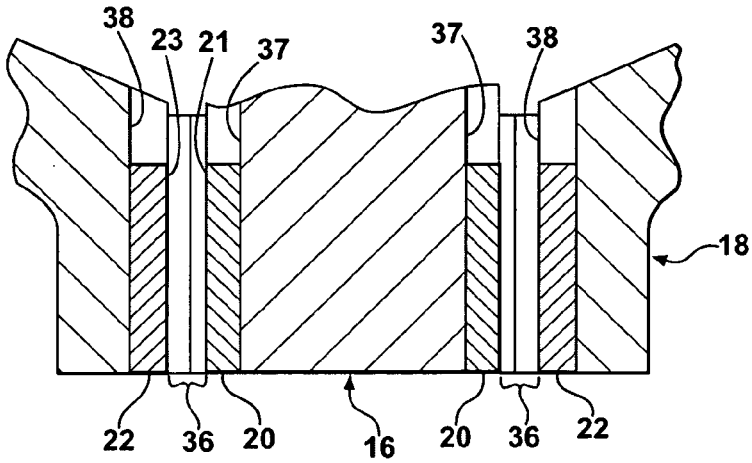
FIG. 5A is a cross-sectional view of one embodiment of region 5 of region 4 of the sparkplug of FIG. 3.
Figure 5B:
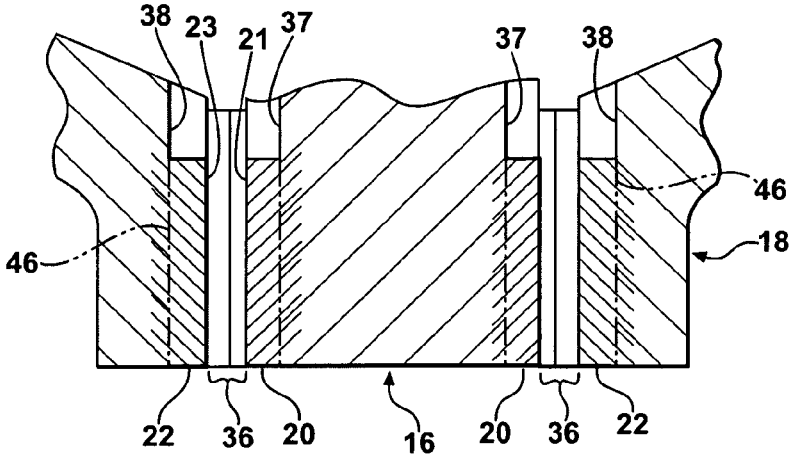
FIG. 5B is a cross-sectional view of a second embodiment of region 5 of region 4 of the sparkplug of FIG. 3.
Figure 5C:
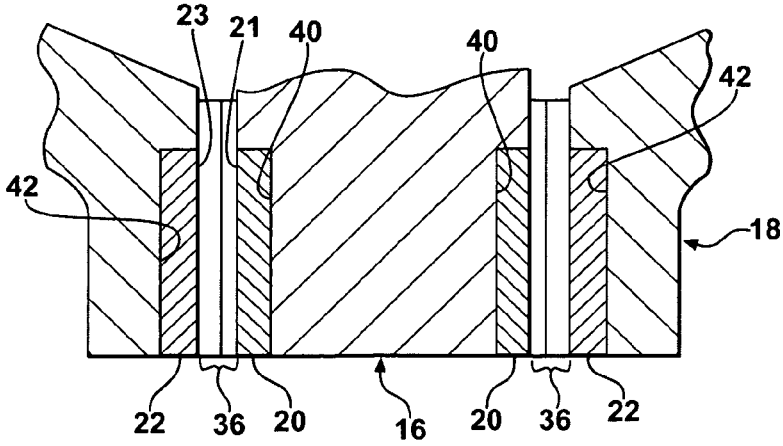
FIG. 5C is a cross-sectional view of a third embodiment of region 5 of region 4 of the sparkplug of FIG. 3.

As shown in FIGS. 3-5, the reflowed electrodes 16, 18 according to the invention may also utilize other ignition device electrode configurations. Referring to FIG. 3, a multi-electrode sparkplug 10 of construction similar to that described above with respect to FIGS. 1, and 2A-2D is illustrated, wherein the sparkplug 10 has a center electrode 16 having a firing tip 20 and a plurality of ground electrodes 18 having firing tips 22. The firing tips 20, 22 are each located at the firing ends of their respective electrodes 16, 18 so that they provide sparking surfaces 21, 23 for the emission and reception of electrons across the spark gap 36. The firing ends are shown in axial cross-section for purposes of illustrating the firing tips which, in this embodiment, comprise metallic material reflowed into place on the firing tips. The firing tips 20, 22 may be formed on an outer surface 37, 38 of the respective electrode 20, 22, as illustrated in FIGS. 5A and 5B, or in a recess 40, 42 as illustrated in FIGS. 5C and 5D. The external and cross-sectional shapes of the recess may be varied as described above.

In accordance with the invention, each firing tip 20, 22 is preferably formed at least in part from at least one noble metal from the group consisting of platinum, iridium, palladium, rhodium, osmium, gold and silver, and may include more than one of these noble metals in combination (e.g., all manner of Pt—Ir alloys). The firing tips 20, 22 may also comprise as an alloying constituent one or more metals from the group consisting of tungsten, yttrium, lanthanum, ruthenium and zirconium. Further, it is believed that the present invention is suitable for use with all known noble metal alloys used as firing tips for sparkplug and other ignition device applications, including the alloy compositions described in commonly assigned U.S. Pat. No. 6,412,465, to Lykowski et al., which is hereby incorporated herein by reference in its entirety, as well as those described, for example, in U.S. Pat. No's. 6,304,022 (which describes certain layered alloy structures) and U.S. Pat. No. 6,346,766 (which describes the use of certain noble metal tips and associated stress relieving layers), which are herein incorporated by reference in their entirety. Additionally, metallic materials used for construction of the electrodes 16, 18, such as Ni or Ni-based alloys, for example, may also be used as an alloying constituent in forming the respective firing tip 20, 22, thereby facilitating the formation of a smooth, homogeneous transition gradient interface region 46 from the electrode material to the firing tip material, as shown in FIGS. 2B, 2D, 5B and 5D. This smooth transition gradient interface region 46 reduces internal thermal stresses, and thus, reduces the potential for the onset of crack propagation. Accordingly, the useful life of the ignition device can be increased.

Referring to FIGS. 6-11, the firing tips 20, 22 are made by reflowing or melting an end portion 47 of a continuous wire 48 (FIGS. 7-9) or multiple wires 48, 50, 52 (FIGS. 10-11) of the desired metals, one or more of which are preferably noble metals and alloys thereof, at the desired location of the firing tip 20, 22 on the firing end of electrodes 16, 18 by application of a high intensity or energy density energy source 54, such as a laser or electron beam. The localized application of energy source 54 is sufficient to cause melting of the wire end or ends 47 sufficient to produce a melt pool 56 in the area where the energy source 54 is applied. As to the shape of the interface, as may be seen for example in FIGS. 2B, 2D, 5B and 5D, the firing tip/electrode interface region 46 may comprise a generally homogeneous transition gradient between the differing material chemistries of the electrode 16, 18 and the active portion of the firing tip 20, 22 which is believed to reduce the propensity for crack propagation and premature failure in response to the thermal cycling experienced by the electrodes 16, 18 in service environments.

As illustrated in FIG. 6, the present invention also comprises a method 100 of manufacturing a metal electrode having an ignition tip for an ignition device. The method a forming step 110 wherein at least a portion of a metal electrode 16, 18 having a firing end and a firing tip portion is formed. Another step 120 includes providing a selected firing tip material in continuous wire form and positioning the end 47 of the wire over the firing tip portion of the electrode 16, 18. Further, another step 130 includes reflowing an end of the continuous metallic wire to form the melt pool 56, which in turn forms the firing tip 20, 22 during a cooling step 140. The method 100 may optionally include a step 140 of forming a recess 40, 42 in the metal electrode 16, 18 prior to the step 130 of reflowing, such that the firing tip 20, 22 is formed at least partially in the recess. The method may also optionally include a step 150 of finish forming the firing tip 20, 22 following the step of cooling 150. Further, the reflowing step 130 may be repeated, as necessary, to add additional layers of material to the firing tips 20, 22, or to form firing tips 20, 22 having multiple layers of different material.

The step 110 of forming at least a portion of the metal electrode 16, 18 may be performed using any conventional method for manufacturing both the center and/or the ground electrode. As referenced above, the electrodes 16, 18 may be manufactured from conventional sparkplug electrode materials, for example, Ni and Ni-based alloys. The center electrodes 16 are frequently formed in a generally cylindrical shape as shown in FIG. 3, and may have a variety of firing tip configurations, including various necked down cylindrical or rectangular tip shapes. The ground electrodes 18 are generally constructed in the form of straight bars, L-shaped elbows, and other shapes, and typically have a rectangular lateral cross-section shape, though any suitable geometry can be used.

The step 140 of forming the recess 40, 42 in the electrode 16, 18 may be performed by any suitable method, such as stamping, drawing, machining, drilling, abrasion, etching and other well-known methods of forming or removing material to create the respective recess 40, 42. The recesses 40, 42 may be of any suitable size and shape, including box-shapes, frusto-conical shapes, pyramids and others, as described herein.

Figure 10:
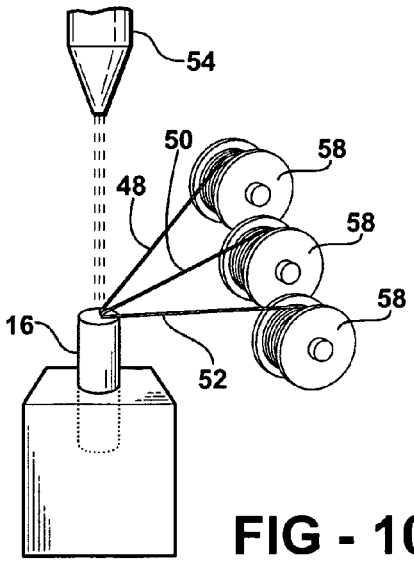
FIG. 10 is a schematic representation of a wire feed mechanism in accordance with the method of constructing a center electrode according to one presently preferred embodiment of the invention.
Figure 11:
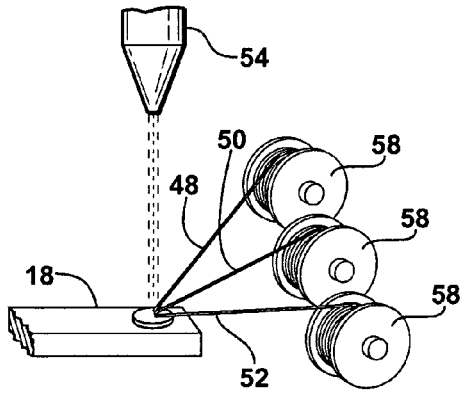
FIG. 11 is a schematic representation of a wire feed mechanism in accordance with the method of constructing a ground electrode according to one presently preferred embodiment of the invention.

The step 120 of providing a selected firing tip material as continuous wires 48, 50, 52 includes providing one or more selected firing tip materials having a free end portion 47 and another end carried by a wire feed mechanism 58 (FIGS. 10-11). It should be recognized that the number of wire feed mechanisms 58 can be varied, as necessary, to provide the number of metal wires desired, at the feed rates desired. The wire feed mechanism 58 is represented here schematically, by way of example and without limitations, as one or more spools adapted to advance or feed the wire or wires 48, 50, 52 carried thereon at a selected feed rate. The wire feed mechanism 58 can be any device capable of carrying elongate, and preferably micro-sized wires, such as about 100 μm-1 mm in diameter, for example, and preferably being able to feed the wires during a feeding step 170 at selected feed rates, such as about 100-200 mm/min, for example. Accordingly, one wire feed mechanism 58 could be used to carry a first type of noble metal wire material for introduction into the firing tip region 20, 22 at one feed rate, and another feed mechanism 58 could be used to carry a different second wire material, such as a different noble metal wire material, and/or a metal wire material generally the same as the electrode material, for example, for introduction into the firing tip region simultaneously with the first wire, and at the same or a different feed rate as the first wire. As such, depending on the firing tip characteristics desired, the number of wire feed mechanisms, the number and types of wire material, and the respective wire feed rates, can be selectively controlled. In addition to varying the types of wire materials carried on the wire feed mechanisms 58, it should be recognized that the cross sectional geometries of the wires 48, 50, 52 may be different from one another, such as having differing diameters, and/or differing shapes, such as round, elliptical, or flat, for example. Accordingly, not only can the type of firing tip material being melted be controlled, but so to can the amount of the selected firing tip materials. Accordingly, the resulting alloying content of the respective firing tip 20, 22 can be closely controlled by selecting the desired types and parameters of wire material and by selecting appropriate feed rates for the different wires to achieve the desired firing tip chemistry. It should be recognized that any one feed rate of selected wires can be continuously altered in process to further provide the finish firing tip chemistry sought. By being able to carefully select and alter the above variables, two or more dissimilar meta-stable materials that are typically difficult to combine are able to be interspersed with one another across gradual transition gradients to produce firing tips having efficient, long-lasting characteristics in use.

Once the end or ends 47 of the selected wires have been located in their desired locations relative to the firing end of the electrode 16, 18 in the positioning step 120, the method 100 continues with the step of reflowing 130 the respective ends 47 of the wires 48, 50, 52 to form the firing tip 20,22. Reflowing is in contrast to prior methods of making firing tips using noble metal alloys, particularly those which employ various forms of welding and/or mechanical attachment, wherein a noble metal cap is attached to the electrode by very localized melting which occurs in the weld heat affected zone (i.e. the interface region between the cap and the electrode), but wherein all, or substantially all, of the cap is not melted. This difference produces a number of differences in the structure of, or which affect the structure and performance of, the resulting firing tip. One significant difference is the shape of the resulting firing tip. Related art firing tips formed by welding tend to retain the general shape of the cap which is welded to the electrode. In the present invention, the melting of the end or ends 47 of the respective metal wires provides liquid flow of the metal wire material, which flows to create the desired shape of the firing tip 20, 22 as it solidifies. In addition, surface tension effects in the melt pool 56 together with the design of the firing end of the electrode 16, 18 can be used to form any number of shapes which are either not possible or very difficult to obtain in related art devices. For example, if the electrode 16, 18 incorporates an undercut recess in the electrode, the flowing metal wire material produced in accordance with this invention can be utilized to create forms not previously made possible.

Figure 7:
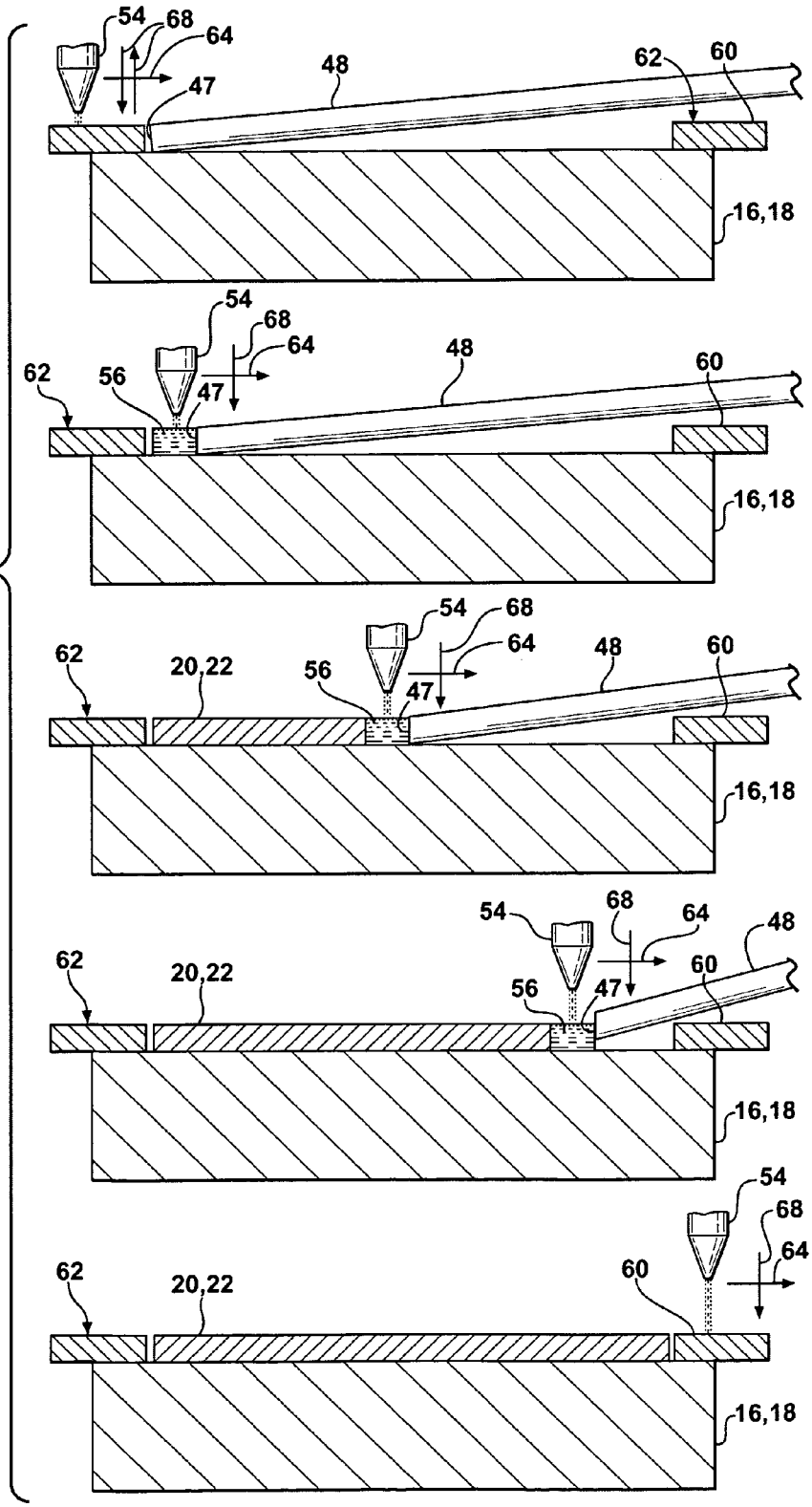
FIG. 7 is a schematic partial representation of the method of FIG. 6 according to one aspect of the invention showing a firing tip being formed on a surface of an electrode.
Figure 8:
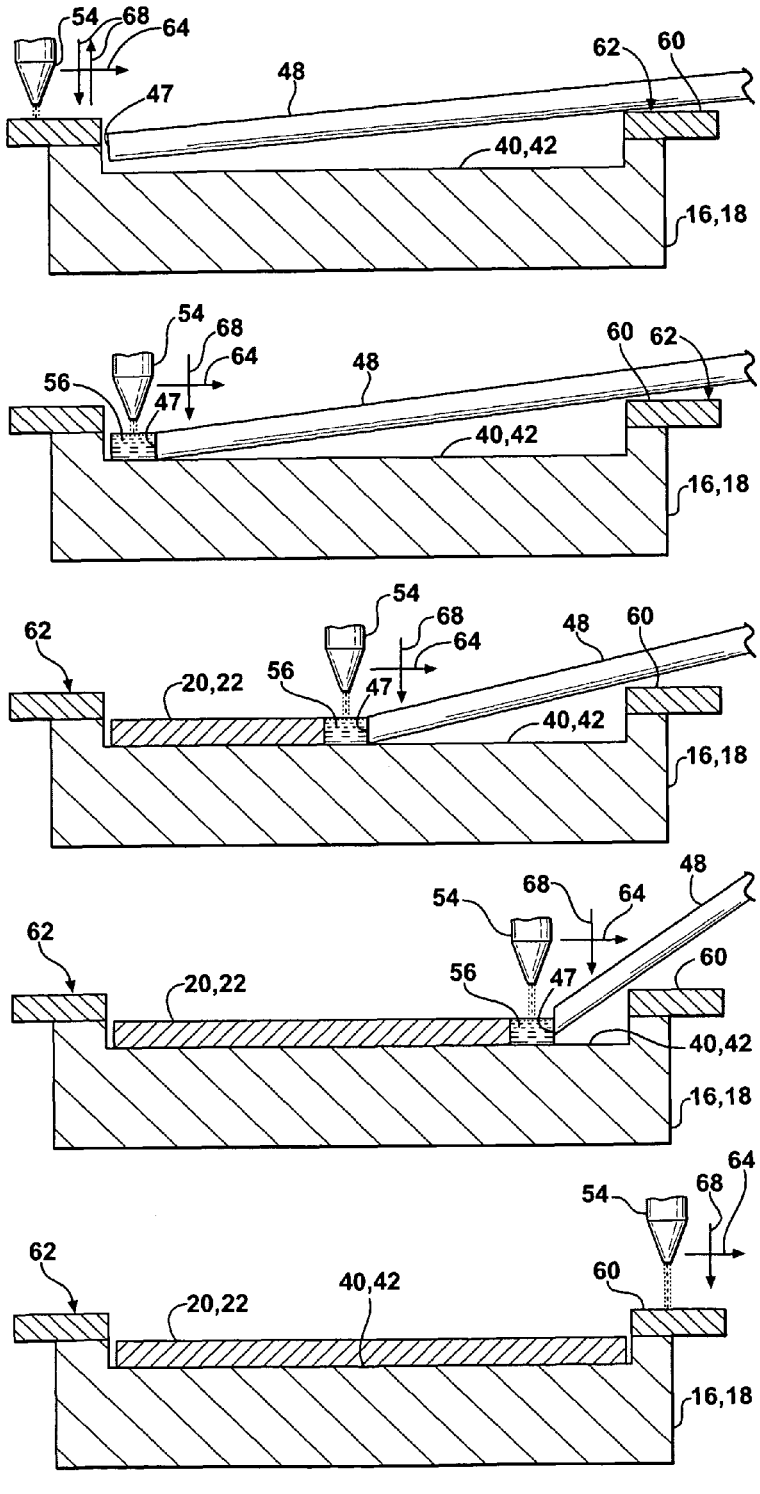
FIG. 8 is a schematic partial representation of the method of FIG. 6 according to another aspect of the invention showing a firing tip being formed at least partially within a recess of an electrode.
Figure 9:
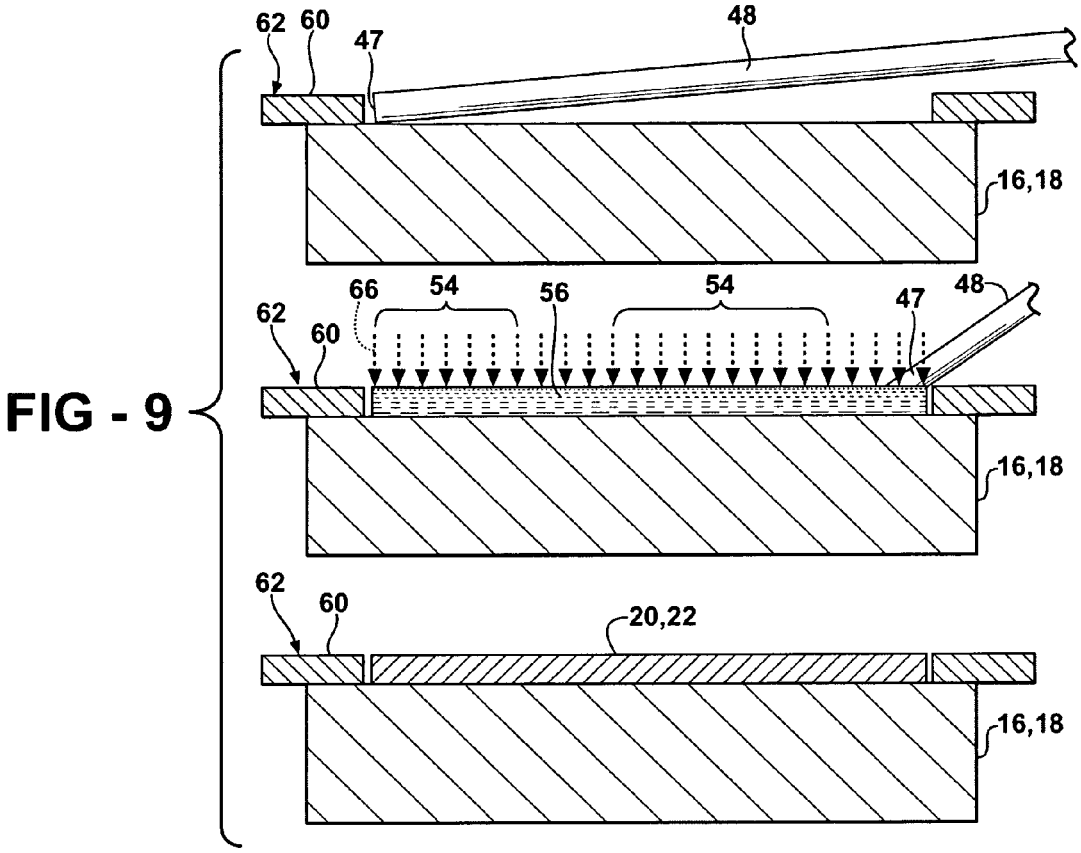
FIG. 9 is a schematic partial representation of the method of FIG. 6 according to yet another aspect of the invention showing a firing tip being formed on an electrode.

The step of reflowing 130 is illustrated schematically in FIGS. 7-9. The energy input 54 may be moved relative to the electrode 16, 18 in a moving step 180. The energy input 54 may be applied as a scanned beam 64 or stationary beam 66 of an appropriate laser having a continuous or pulsed output, which is preferably applied on focus, but could be applied off focus, depending on the desired energy density, beam pattern and other factors desired. Because lasers having the necessary energy output to melt the end of the continuous wire or wires also have sufficient energy to cause melting of the electrode surface proximate the wire ends 47 being melted, it may be desirable to utilize a mask or shield, such as a gas shield of argon, nitrogen or helium, for example, which can be delivered coaxially by a nozzle about the firing tip region, or a metal mask 60 could be disposed about the firing tip region. The metal mask 60 preferably has a polished surface 62 which is adapted to reflect the laser energy over those portions of the electrodes 16, 18 proximate the firing tip region, thereby generally limiting melting to the ends 47 of the continuous wire 48, 50, 52 in the firing tip region, and potentially to portions of the electrode 16, 18 proximate the firing tips 20, 22, if such melting is desired.

In FIG. 7, the scanned beam 64 is used to reflow one or more ends 47 of continuous metal wire 48 so as to form the respective firing tip 20, 22. FIG. 8 is similar to FIG. 7, except that the firing tip 20, 22 is being formed in the recess 40, 42 of the respective electrode 16, 18. FIG. 9 is also similar to FIG. 7, except that the beam used to melt the end of the continuous wire 48 is stationary rather than scanned. It should be recognized that though the beam is stationary, that the electrode 20, 22 and/or mask 60 may be rotated under the stationary beam during the moving step 180.

While it is expected that many types industrial lasers may be utilized in accordance with the present invention, including those having a beam with a distributed area at the focal plane of approximately 12 mm by 0.5 mm, and CO2 and diode lasers, for example, it is contemplated that those having a single point shape at the focal plane, such as provided by small spot Neodymium:YAG lasers, are preferred. In addition, it is generally preferred that the beam of the laser 54 have substantially normal incidence with respect to the surface of the electrode 16, 18 and/or the wire surface being melted. Depending on the diameter and/or shape of the metallic wire compared to the size of the beam and other factors, such as the desired heating rate, thermal conductivity and reflectivity of the metallic wire 48, 50, 52 and other factors which influence the heating and/or melting characteristics of the wire, as mentioned, the laser 54 may be held stationary with respect to the electrode 16, 18 and wire 48, 50, 52, or scanned across the surface of the electrode 16, 18 and along the length of the wire 48, 50, 52 during the moving step 180 in any pattern that produces the desired heating/reflowing result. In addition, the electrode 16, 18 may be rotated and/or moved vertically in the moving step 180 with respect to the beam of the laser. Relative vertical movement between the laser 54 and electrode 16, 18 away from one another is believed to provide more rapid solidification of the melt pool 56, thereby decreasing the time needed to produce the firing tip 20, 22, and thus, increasing the manufacturing efficiencies. As an alternative or addition to scanning the beam of the laser, the electrode 16, 18 may be scanned with respect to the beam of the laser 54 to provide the desired relative movement. Any of the relative movements mentioned above in the moving step 180 can be imparted by linear slides, rotary tables, multi-axis robots, or beam steering optics, by way of examples and without limitation. In addition, any other suitable mechanism for rapidly heating the metallic wire ends 47, such as various high-intensity, near-infrared heaters may be employed, so long as they are adapted to reflow the wire ends 47 and be controlled to limit undesirable heating of electrode 16, 18.

In combination with the step of reflowing 130, a monitoring step 190 including a feedback system can be incorporated to enhance to formation of the firing tip 20, 22. The feedback system, by way of example and without limitation, can include a vision system and control loop to monitor the melt pool 56. The control loop can communicate the melt pool characteristic being monitored, such as temperature, for example, back to one or more of the parameters at least partially responsible for forming the firing tip, such as the laser 54, the wire feed mechanism 58, or any of the mechanisms controlling relative movement of the electrode 16, 18 to the laser 54, thereby allowing continuous real-time adjustments to be made. As such, any one of the parameters can be adjusted in real-time to provide an optimally formed firing tip 20, 22. For example, the laser intensity could be increased or decreased, the rate of wire feed could be increased or decreased, and/or the rate of relative scanning and/or vertical movement of the electrode relative to the laser could be increased or decreased.

The step 160 of finish forming the reflowed metal firing tip 20, 22 may utilize any suitable method of forming, such as, for example, stamping, forging, or other known metal forming methods and machining, grinding, polishing and other metal removal/finishing methods.

The reflowing step 130 may be repeated as desired to add material to the firing tip 20, 22. The layers of material added may be of the same composition or may have a different composition such that the coefficient of thermal expansion (CTE) of the firing tip is varied through its thickness, wherein the CTE of the firing tip layers proximate the electrode are generally similar to the electrode, and the CTE of the firing tip layers spaced from the electrode being that desired at the firing surface 21, 23 of the firing tip 20, 22.

It will thus be apparent that there has been provided in accordance with the present invention an ignition device and manufacturing method therefor which achieves the aims and advantages specified herein. It will, of course, be understood that the foregoing description is of preferred exemplary embodiments of the invention and that the invention is not limited to the specific embodiments shown and described. Accordingly, various changes and modifications will become apparent to those skilled in the art. All such changes and modifications are intended to be within the scope of the present invention. The invention is defined by the following claims.

The invention claimed is:

1. A method of manufacturing an electrode for an ignition device, comprising:

providing an electrode body having a firing tip region;

providing a continuous wire of selected firing tip material having a free end and an opposite end carried by a feed mechanism configured to advance said wire at a predetermined rate;

providing a laser for emitting a high energy laser beam;

feeding the free end of said wire via said feed mechanism into said firing tip region and into the laser beam;

reflowing said free end during the feeding step in the laser beam and forming a melt pool of the continuous wire material on said firing tip region with a portion of said continuous wire remaining on said feed mechanism for use in the manufacture of a subsequent ignition device;

moving said electrode body and said laser vertically away from one another along an axis of said laser beam during the reflowing step; and cooling said melt pool to form a solidified firing tip surface of said selected firing tip material.

2. The method of claim 1 further including providing a plurality of continuous wires of selected firing tip material having free ends and opposite ends carried by said feed mechanism and feeding said free ends into the firing tip region simultaneously to form said firing tip surface.

3. The method of claim 2 further including providing said plurality of wires formed from different materials from one another.

4. The method of claim 3 further including providing at least one of said plurality of wires formed from the same material as said electrode body.

5. The method of claim 2 further including feeding the free end of at least one of said plurality of wires into said firing tip region at a different rate than the other free ends.

6. The method of claim 2 further including feeding each of said free ends into the firing tip region at different rates from one another.

7. The method of claim 2 further including providing at least one of said wires having a different cross-sectional geometry from the other wires.

8. The method of claim 2 further including carrying said wires on separate feeding mechanisms.

9. The method of claim 2 further including varying the feed rate of at least one of said wires during the reflowing step.

10. The method of claim 1 further including varying the feed rate of said free end into the firing tip region during the reflowing step.

11. The method of claim 1 further including providing the wire as a noble metal.

12. The method of claim 1 further including forming a recess in said electrode body and forming said melt pool in said recess.

13. The method of claim 1 further including varying the feed rate of said wire toward said firing tip region during the reflowing step.

14. The method of claim 1 further including moving said laser relative to said electrode body with said electrode body remaining stationary during the reflowing step.

15. The method of claim 14 further including moving said laser away from said electrode body during the reflowing step.

16. The method of claim 1 further including varying the intensity of energy output from said laser during the reflowing step.

17. The method of claim 1 further including monitoring the melt pool characteristics with a monitoring device during the reflowing step.

18. The method of claim 17 further including relaying information from said monitoring device to at least one of said laser or said feed mechanism and making real-time adjustments to parameters of said at least one of said laser or said feed mechanism.

19. The method of claim 18 further including making the real-time adjustments by varying at least one of the intensity of energy being emitted from said laser or the rate of feed of said wire from said feed mechanism in response to said information during the reflowing step.

20. A method of manufacturing an ignition device for an internal combustion engine, comprising:

providing a housing;

securing an insulator within the housing with an end of the insulator exposed through an opening in the housing;

mounting a center electrode within the insulator with a firing tip region of the center electrode extending beyond the insulator;

extending a ground electrode from the housing with a firing tip region of the ground electrode being located opposite the firing tip region of the center electrode to define a spark gap therebetween;

providing a continuous wire of a selected firing tip material having a free end and an opposite end carried by a feed mechanism;

providing a laser for emitting a high energy laser beam;

feeding the free end of said wire via said feed mechanism into at least one of said firing tip regions;

reflowing the free end of the wire in the laser beam during the feeding step to form a melt pool of the wire material on at least a selected one of said firing tip regions of said center electrode or said ground electrode;

moving said selected one of said firing tip region and said laser away from one another along an axis of said laser beam during the reflowing step; and cooling said melt pool to form a solidified firing tip of said selected firing tip material.

21. The method of claim 20 further including providing a plurality of continuous wires of selected firing tip material having free ends and opposite ends carried by said feed mechanism and feeding said free ends into the firing tip region.

22. The method of claim 21 further including carrying said wires on separate feeding mechanisms.

23. The method of claim 21 further including providing said plurality of wires formed from different material from one another.

24. The method of claim 23 further including providing said wires formed from different material from said electrodes.

25. The method of claim 23 further including providing one of said wires formed from the same material as at least one of said electrodes.

26. The method of claim 21 further including feeding the free end of at least one of said wires into the firing tip region during said reflowing step at a different rate from the other wires.

27. The method of claim 21 further including varying the feed rate of at least one of said free ends toward the firing tip region during the reflowing step.

28. The method of claim 21 further including providing at least one of said wires having a different cross-sectional geometry from the other wires.

29. The method of claim 20 further including providing said wire as a noble metal from a group of iridium, platinum, palladium, rhodium, gold, silver and osmium, and alloys thereof.

30. The method of claim 29 further including alloying the noble metal from the group of tungsten, yttrium, lanthanum, ruthenium and zirconium.

31. The method of claim 20 further including varying the feed rate of said free end into the firing tip region during said reflowing step.

32. The method of claim 20 further including forming a recess in said selected one of said firing tip regions of said center electrode or said ground electrode and forming said melt pool in said recess.

33. A method of manufacturing an ignition device for an internal combustion engine, comprising:

providing a housing;

securing an insulator within the housing with an end of the insulator exposed through an opening in the housing;

mounting a center electrode within the insulator with a firing tip region of the center electrode extending beyond the insulator;

extending a ground electrode from the housing with a firing tip region of the ground electrode being located opposite the firing tip region of the center electrode to define a spark gap therebetween;

providing a continuous wire having a free end and an opposite end carried by a feed mechanism;

providing a high energy emitting device;

feeding the free end of said wire via said feed mechanism into at least one of said firing tip regions;

reflowing the free end of the wire with the high energy emitting device during the feeding step to form a melt pool of the continuous wire material on at least a selected one of said firing tip regions of said center electrode or said ground electrode;

moving said selected one of said firing tip region and said high energy emitting device vertically away from one another during the reflowing step; and monitoring selected characteristics of the melt pool with a monitoring device during the reflowing step and communicating a signal from said monitoring device to at least one of said high energy emitting device or said feed mechanism and varying at least one of the intensity of energy being emitted from said high energy emitting device or the rate of feed of said wire from said feed mechanism during the reflowing step in response to said signal.

* * * * *